US005671889A

United States Patent [19]

Petty

[11] Patent Number: 5,671,889

[45] Date of Patent: Sep. 30, 1997

[54] WATERPROOFING SPRAY APPARATUS

[76] Inventor: Ralph S. Petty, 6680 White River Pl., Fishers, Ind. 46038

[21] Appl. No.: 390,084

[22] Filed: Feb. 17, 1995

[51] Int. Cl.[6] ..... B05B 15/08

[52] U.S. Cl. ..... 239/418; 239/532; 239/587.1; 239/588

[58] Field of Search ..... 239/418, 532, 239/304–306, 587.1–587.6, 548, 588, 420; 401/28, 39, 35

[56] References Cited

U.S. PATENT DOCUMENTS

| | | | |
|---|---|---|---|
| 1,150,461 | 8/1915 | Schurs | 239/587.6 X |
| 1,998,100 | 4/1935 | Shepherd et al. . | |
| 3,040,992 | 6/1962 | Wiegand | 239/306 X |
| 3,612,356 | 10/1971 | McVey | 239/172 X |
| 3,676,198 | 7/1972 | McGroarty . | |
| 4,046,357 | 9/1977 | Twitchell | 239/304 X |
| 4,273,813 | 6/1981 | Meddaugh . | |
| 4,287,242 | 9/1981 | Monden et al. . | |
| 4,323,196 | 4/1982 | Logue et al. | 239/532 |
| 4,344,991 | 8/1982 | Gray . | |
| 4,491,608 | 1/1985 | Thygesen . | |
| 4,520,051 | 5/1985 | Harrison . | |
| 4,745,011 | 5/1988 | Fukuta et al. . | |
| 4,789,100 | 12/1988 | Senf | 239/304 |
| 5,064,123 | 11/1991 | Aiello et al. | 239/305 X |
| 5,219,914 | 6/1993 | Warbuton, Jr. . | |
| 5,225,239 | 7/1993 | Ostin . | |
| 5,260,101 | 11/1993 | Larson et al. . | |
| 5,304,390 | 4/1994 | Condron et al. . | |
| 5,352,531 | 10/1994 | Roberts et al. . | |

FOREIGN PATENT DOCUMENTS

| | | | |
|---|---|---|---|
| 733770 | 3/1932 | France | 239/532 |
| 301176 | 3/1971 | U.S.S.R. | 239/532 |

*Primary Examiner*—Kevin Weldon

*Attorney, Agent, or Firm*—Woodard, Emhardt, Naughton, Moriarty & McNett

[57] ABSTRACT

The present invention relates to a waterproofing spraying apparatus for delivering a waterproofing coating to the exterior surface of a basement wall which requires moisture proofing. The spraying apparatus includes a remote controlled airless fluid pressurizing unit, a pair of hoses and a spray gun. The spray gun including a moveable arm which is moveable between an extended position and a deflected position. Attached to the end of the moveable arm is a pair of nozzles for delivering the waterproofing coating from the spray gun. The waterproofing coating comprising two fluids which are mixed external to the spray gun after leaving their respective nozzle.

14 Claims, 7 Drawing Sheets

WATERPROOFING SPRAY APPARATUS

BACKGROUND OF THE INVENTION

The present invention relates generally to the design and construction of a water proofing spray apparatus for use in waterproofing an exterior surface of basement walls. More particularly, the present invention includes a remote controlled airless spraying machine having a spray gun with a moveable arm for delivering waterproofing material onto basement walls. Although the invention was developed for use in applying a waterproofing coating to the exterior surface of a basement wall, certain applications may be outside of this field.

In todays technologically advanced building industry it is generally well known to apply a waterproofing coating during the construction phase to the exterior surface of porous concrete or masonry basement walls. Typically, for a period of time after the construction of the basement the subterrain portion of the wall is readily accessible by a workman for applying a waterproofing coating thereon. The application of a waterproofing coating onto the exterior surface of the basement wall is designed to minimize or prevent ground water seepage into the basement. Ground water seepage is a direct result of hydrostatic pressure that exerts a force which often drives the ground water through voids or pores in the basement walls.

The rate and quantity of ground water seepage through the basement wall is significantly effected by the soil conditions immediately surrounding the building. If the land surrounding the basement walls includes subsoil with a high clay content, naturally high water tables, or the lack of adequate drainage the ground water seepage will be amplified. Further, the lack of proper workmanship, the use of inferior materials and an improper design are just some of the factors that contribute to an increase in ground water seepage. Inferior or substandard mortar, block, or concrete creates paths or voids which allows the ground water to pass through the basement wall into the basement. Alternatively, if the basement wall is of a poured substantially solid concrete construction it may have imperfect bonding between the layers which allows for the seepage of ground water therebetween.

It is generally known in the building industry to provide a drainage tile adjacent the perimeter of the basement walls for channeling the ground water therefrom. Applying a water impervious membrane or coating to the exterior surface of the walls has generally been utilized by the building industry to minimize or prevent the seepage of ground water through the basement walls. Numerous techniques have been employed to apply waterproofing coating onto the exterior surface of the basement walls. The most common techniques have been to apply the waterproofing coatings with brushes, trowels or spraying equipment. The utilization of brushes or trowels to apply the waterproofing compound has been very labor intensive and often results in a coating with cracks, voids, and unevenness. Pragmatically because of the forementioned problems the application of the waterproofing compound with a trowel or brush has been limited to relatively small surface areas.

A more commonly used technique to apply the waterproofing coating onto the exterior surface of the basement wall is with a spraying apparatus. Common limitations associated with prior spraying apparatuses have been attributed to the inflexibility of the spraying apparatus, and the inability to remotely control the operation of the device. Further, many of the prior spraying machines have required the workman to change their techniques of applying the waterproofing coating to the exterior surface depending upon the geometry of the basement walls, rather than allowing the workman to reorient the nozzles to facilitate delivering the waterproofing compound to the exterior surface.

Even with a variety of earlier designs there remains a need for an improved waterproofing spray apparatus. The present invention satisfies this need in a novel and unobvious way.

SUMMARY OF THE INVENTION

One embodiment of the present invention contemplates a waterproofing spraying apparatus. The spray apparatus for delivering two fluids onto a surface, comprising: a body; a moveable arm mounted to the body, the arm moveable with respect to the body between an extended position and a deflected position; a pair of nozzles connected to the moveable arm, wherein a portion of at least one of the two fluids exit the spray gun through at least one of said nozzles; and a pair of conduits extending along at least a portion of the body and the moveable arm, the pair of conduits preventing the mixing of the two fluids within the spray apparatus, each of the conduits having one end for receiving one of the fluids therein and having an opposite other end connected to one of the nozzles.

One object of one form of the present invention is to provide an improved waterproofing spray apparatus.

Related objects and advantages of the present invention will be apparent from the following description.

DESCRIPTION OF THE PREFERRED EMBODIMENT

Figure 1:
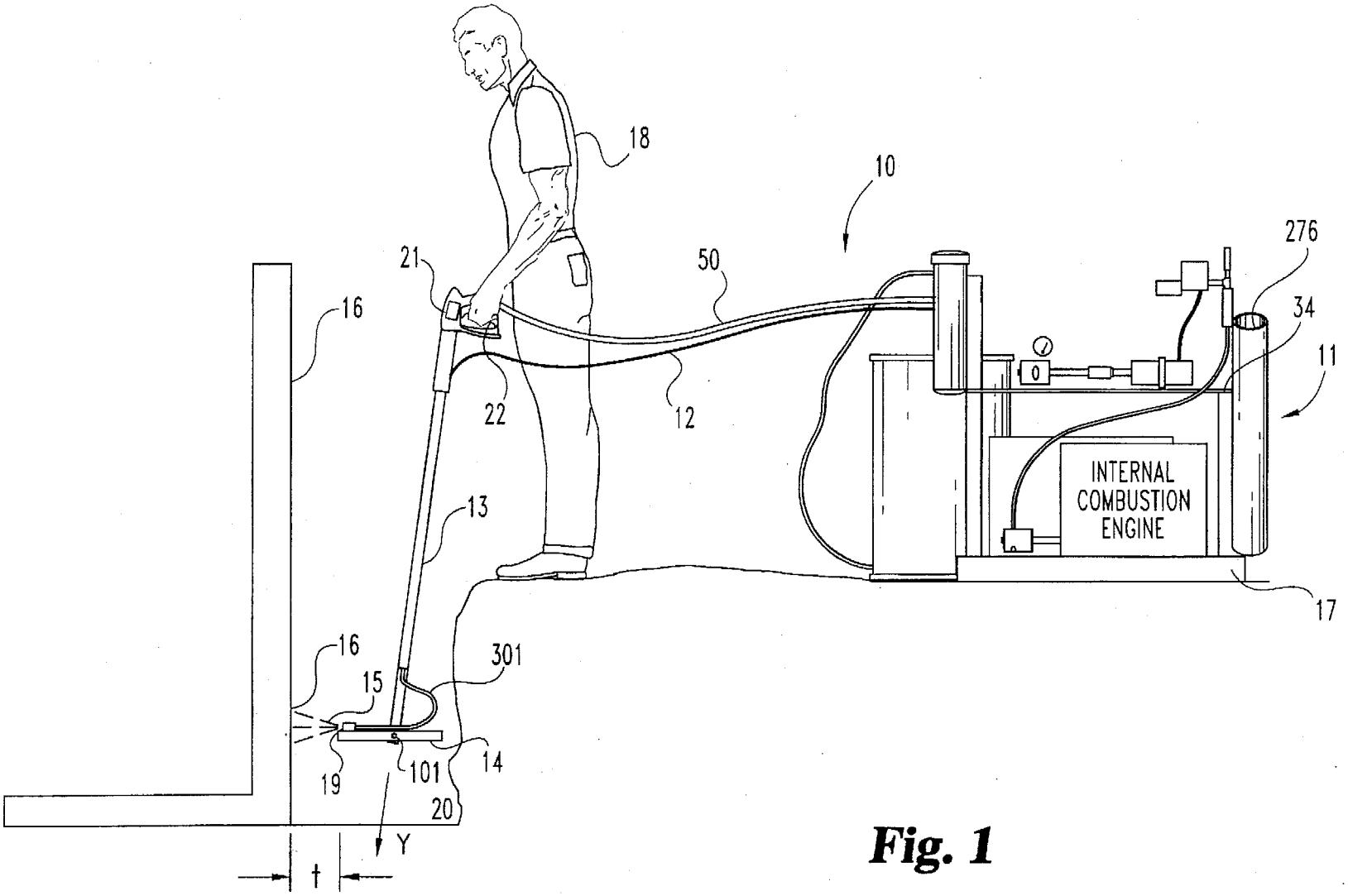
FIG. 1 is an illustrative view of a waterproofing spray apparatus according to one form of the present invention that is being used to apply a waterproofing coating to a basement wall.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a waterproofing spray apparatus 10 which includes a remote controlled fluid pressuring unit 11, a pair of hoses 12 and 50, and a spray gun 13. The three components have been integrated together to produce a palletized unit that can fit in the back of a truck, be mounted on a trailer, or delivered to the job site and moved about with the aid of a forklift truck. A holder 276 for receiving the spray gun 13 therein is connected to structure 34. Holder 276 is closed at one end and is full of a solvent, such as kerosene, that is utilized to soak the spray gun 13 in. It is important to understand that the waterproofing spray apparatus 10 is preferably designed to provide a waterproofing coating to a basement wall 16, however, the utilization of the apparatus to provide a waterproofing coating on other surfaces which require a moisture proof seal is contemplated.

The service technician 18 is operating the waterproofing spray apparatus 10 to deliver a two part waterproofing coating to cover at least a portion of the basement wall 16. In the preferred embodiment the spray gun 13 includes a moveable arm 14 which pivots about pivot point 101 and is shown in a deflected position with spray nozzles 19 and 250 (nozzle 250 not being illustrated) oriented towards the exterior surface of the basement wall 16. The moveable arm 14 facilitates the delivery of the waterproofing coating from the spray gun 13 to the wall surface. The moveable arm 14 being moveable with respect to the body of spray gun 13 from an extended position which is substantially parallel with arrow y to a deflected position as illustrated in FIG. 1.

The operator 18 is demonstrating the flexibility and utility of the spraying apparatus 10 by being able to spray the subterrain basement wall 16 without having to place themselves within the trench 20. Further, the spray gun 13 includes controls 21 which enable the operator to remotely control the fluid pressurizing apparatus 11. The controls 21 can remotely start and stop the internal combustion engine 25, control the liquid pressurizing pumps 32 and 33 and control the delivery of the waterproofing coatings from the spray gun 13.

In spraying a waterproofing coating on the exterior surface of basement wall 16 the operator 18 adjusts the moveable arm 14 of spray gun 13 to orient the nozzles 19 and 250 to facilitate the delivery of the waterproofing coating to the wall 16. The operator than proceeds to move the spray gun 13 along the wall 16 until the desired portion or the whole wall has been covered with the waterproofing coating 16. When moving the spray gun 13 along the wall the nozzles 19 and 250 remain in a spaced apart relationship from the wall.

Figure 2:
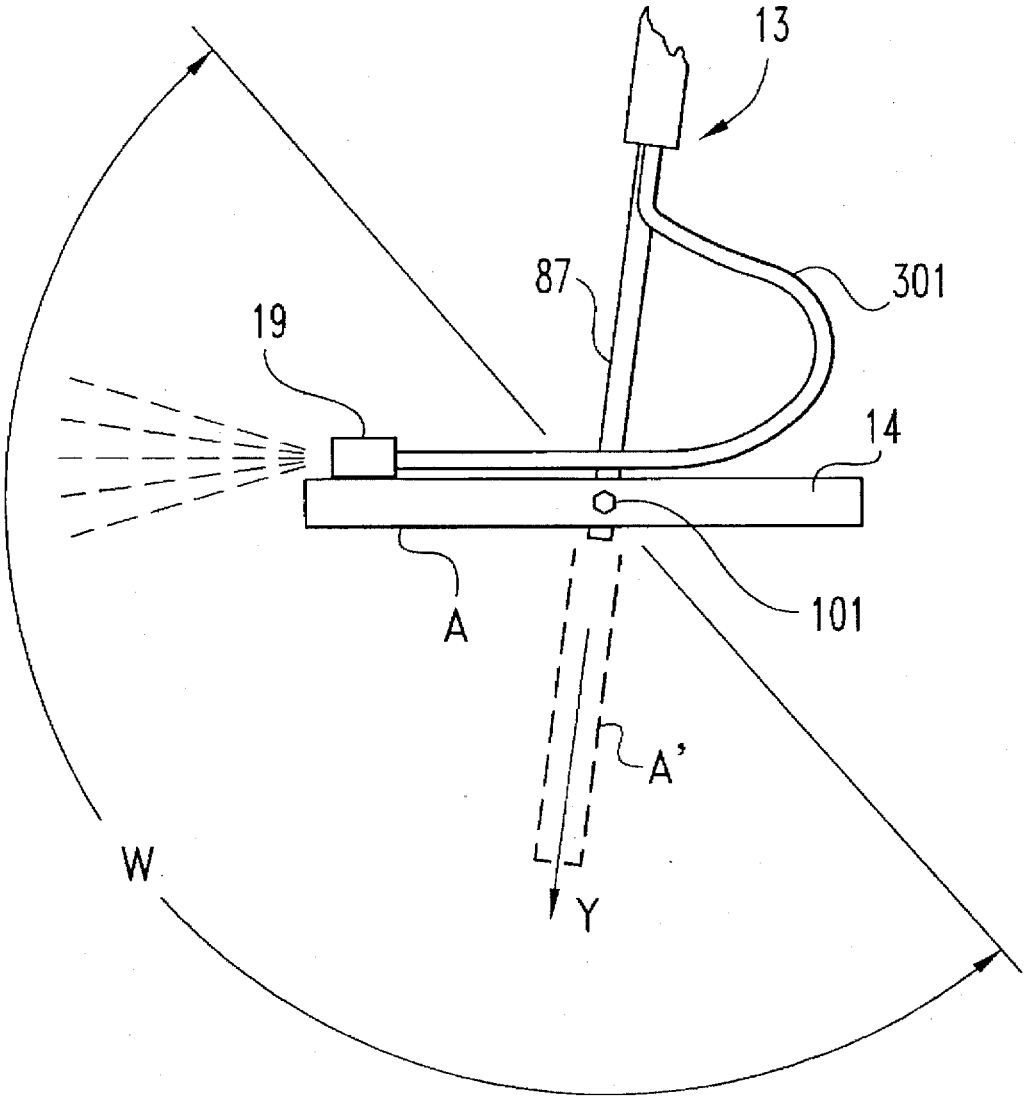
FIG. 2 is an enlarged partial side elevational view of the spray gun comprising a portion of the waterproofing spray apparatus of FIG. 1.

Referring to FIG. 2, there is illustrated an enlarged partial side elevational view of spray gun 13. The moveable arm 14 being pivotally connected to a member 87 of spray gun 13. In the preferred embodiment the moveable arm 14 can be moved through an arc W. When the moveable arm is in its extended position A' which is shown in phantom lines it is substantially aligned with member 87. When the moveable arm 14 is moved relative to member 87 it is in a deflected position, one such deflected position being indicated by position A. It is contemplated that the moveable arm 14 can be moved to a number of locations between position A and A'. In an alternate form of the present invention moveable arm 14 is free to travel a greater distance with respect to bar 87, than is indicated by arc W.

Figure 3:
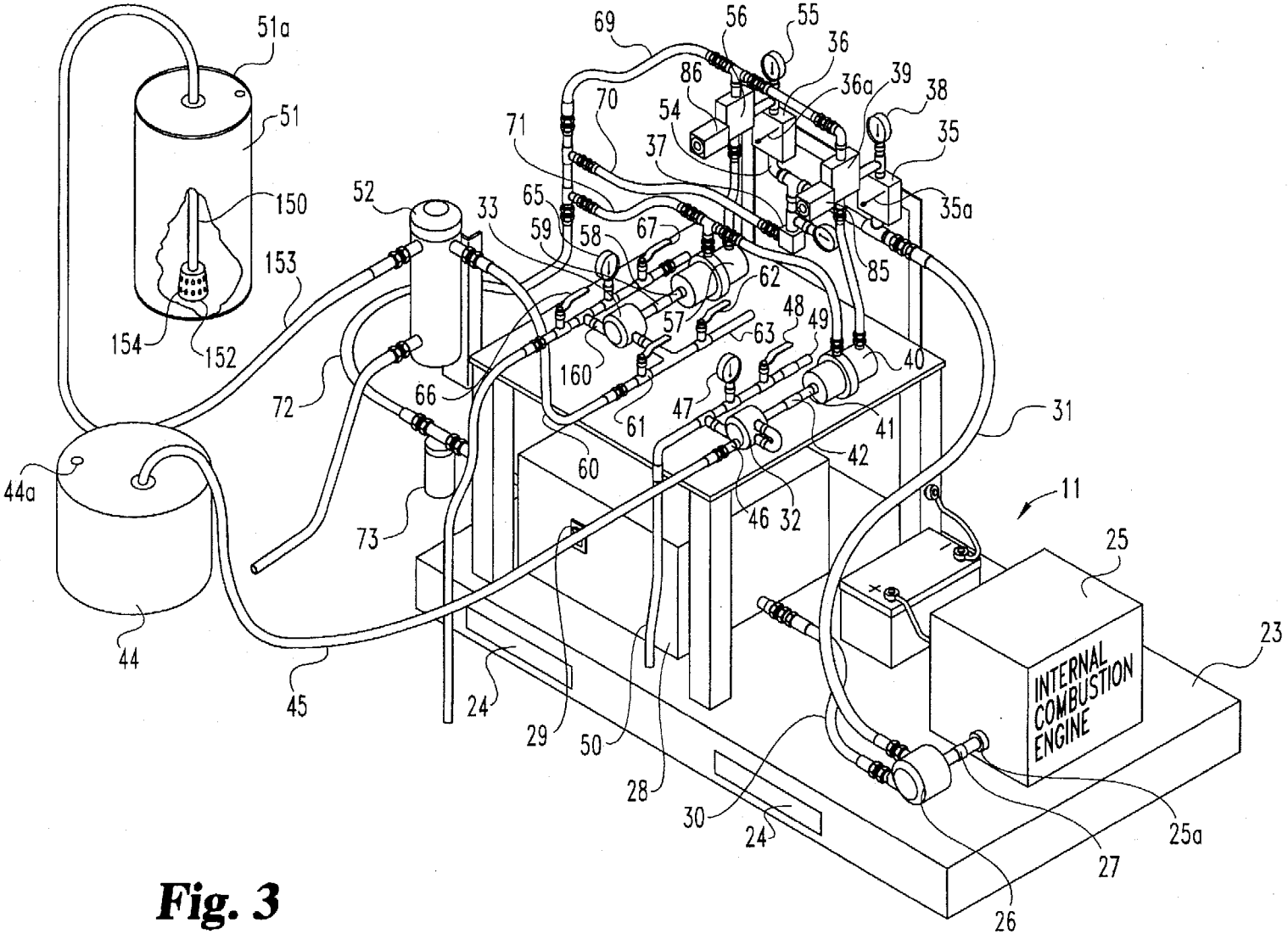
FIG. 3 is a perspective view of the remote controlled fluid pressurizing unit which comprises a portion of the waterproofing spray apparatus of FIG. 1.

With reference to FIG. 3, there is illustrated a perspective view of the remote controlled fluid pressurizing apparatus 11. In the preferred embodiment the fluid pressurizing apparatus 11 is mounted on a pallet 23. Pallet 23 includes a pair of openings 24 for receiving the forks of a forklift truck (not illustrated) therein. The palletizing of the fluid pressurizing apparatus 11 allows for the convenient movement and transportation of the equipment. It is understood that the footprint of pallet 23 could be minimized by rearranging the components to fit in a vertically stacked relationship.

A power source 25 provides the necessary power for driving the hydraulic pump 26. In the preferred embodiment the power source 25 is an internal combustion engine, such as a Kohler Command 11 horsepower horizontal crankshaft engine which is manufactured by Kohler Engine Company in Kohler, Wis.. A flexible drive coupling 27 connects the output shaft **25*a* of the internal combustion engine 25 with the hydraulic pump 26**.

In the preferred embodiment the hydraulic pump 26 is a positive displacement pump capable of delivering hydraulic fluid at a flow rate of 5.7 gallons per minute, with a pressure of about 2,000 p.s.i.g. (pounds per square inch gauge). Hydraulic pumps of this type are generally well known to individuals skilled in the art. One pump of this type is a model D-SER-Gear Pump P26G that is manufactured by Parker. The positive displacement hydraulic pump 26 draws the hydraulic fluid from a fluid reservoir 28. The fluid reservoir 28 being designed to hold a supply of hydraulic fluid, and in the preferred embodiment can hold 10 gallons of hydraulic fluid. In the preferred embodiment the hydraulic reservoir 28 is a model 62152 manufactured by Dayton Electric Manufacturing Company of Chicago, Ill.. A fluid level indicator 29 is located on the side of the hydraulic reservoir 28 to allow an operator to check the quantity of hydraulic fluid in the system.

A flexible high pressure hydraulic hose 30 connects the fluid reservoir 28 with the inlet side **26*a* of hydraulic pump 26. The hydraulic pump 26 pressurizes the hydraulic fluid, and the fluid exits the hydraulic pump 26 through a flexible high pressure hydraulic hose 31. The high pressure hydraulic fluid is utilized to drive the pair of fluid pressurizing pumps 32 and 33. The fluid pressurizing pumps 32 and 33 are utilized to pressurize the two fluids comprising the waterproofing coating that are sprayed by the spray gun 13. In the preferred embodiment one of the fluids comprising the waterproofing coating is an asphalt emulsion having a tradename EPROLINE-S which is distributed by Epro Services, L.C., Goodard, Kans.. The other fluid is a coagulant such as an aqueous solution of calcium chloride, which in the preferred embodiment has a mixture of one pound of calcium chloride with five gallons of water. The two fluids comprising the waterproofing coating do not engage one another until they are discharged from the spray gun 13, thereby reducing or eliminating the hardening of the material within the waterproofing spray apparatus 10. The two fluids are individually pressurized by the fluid pressurizing pumps 32 and 33 which are supported by a structure 34**.

In the preferred embodiment the structure 34 is connected to the pallet 23 and supports and protects the components comprising the fluid pressurizing apparatus 11. The hydraulic hose 31 delivers the high pressure hydraulic fluid to a pair of diverter valves 35 and 36. A pressure regulator 37 is connected to the hydraulic system to allow the operator to adjust the pressure of the hydraulic fluid that was pressurized by pump 36. In the preferred embodiment the pressure regulator 37 is adjusted to reduce the pressure of the hydraulic fluid from about 2,000 p.s.i.g. to about 750 p.s.i.g. The diverter valves 35 and 36 have adjustment levers **35*a* and 36*a* which are moveable by the operator to adjust the pressure of the hydraulic fluid that exits each valve. A gauge 38 is connected to the diverter valve 35 to indicate the pressure of the exiting hydraulic fluid. In the preferred embodiment diverter valve 35 is adjusted such that the pressure of the hydraulic fluid on its output side is about 200 p.s.i.g. The diverter valve 35** is adjusted by the operator to change the hydraulic fluid pressure depending upon the nozzle size, viscosity of the fluid, surface temperature, air temperature and characteristics of the material being sprayed. It is understood that there is a wide range of pressure valves that can be utilized to spray the waterproofing coatings.

A solenoid valve 39 is utilized to control the flow of hydraulic fluid from the diverter valve 35 to a hydraulic motor 40. Hydraulic motors are generally known in the art as being useful to convert the energy from the pressurized fluids into rotational motion. Hydraulic motor 40 converts the pressurized hydraulic fluid flow into the rotary motion of shaft 41. A flexible drive coupling 42 is utilized to connect the output shaft 41 from hydraulic motor 40 to the fluid pressurizing pump 32. In the preferred embodiment the fluid pressurizing pump 32 is a MOYNO® 200 series SP pump, that is manufactured by Robbins and Meyers Inc. of Springfield, Ohio. The stainless steel fluid pressure pump 32 is utilized to pressurize the aqueous solution of calcium chloride. In the preferred embodiment the maximum discharge pressure from fluid pressurizing pump 33 is 40 p.s.i.g. In the preferred embodiment the aqueous solution of calcium chloride is stored in a barrel 44 having a vent 44*a*, that is remote from pallet 23. A flexible hose 45 connects the barrel 44 full of the aqueous solution of calcium chloride to an inlet 46 of fluid pressurizing pump 32.

A gauge 47 is located on the outlet side 32*a* of fluid pressurizing pump 32 to indicate the discharge pressure of the aqueous solution of calcium chloride. The pressurized aqueous solution of calcium chloride is discharged from the fluid pressurizing apparatus 11 through a flexible hose 50. A shutoff valve 48 is located intermediate the gauge 47 and a priming connection 49. In the normal operating condition the shut off valve 48 remains closed, however the valve 48 is opened when it is necessary to prime the fluid pressurizing pump 32. The priming connection 49 allows for the coupling of an external fluid supply (not illustrated) having sufficient fluid flow to prime the fluid pressurizing pump 32.

The handling of the asphalt emulsion fluid within the fluid pressurizing apparatus 11 is substantially similar to the handling of the aqueous solution of calcium chloride. The asphalt emulsion is stored in a barrel 51, having a vent 51*a* which is remote from pallet 23. The suction generated by fluid pressurizing pump 33 draws the asphalt emulsion from the barrel 51 through hose 153 to the pump. The barrel 51 has a top suction feed which includes a siphon tube 150 having a filter 152 on its distal end. In the preferred embodiment the filter 152 is a cylindrical structure having a plurality of holes 154 formed therein. The filter 152 prevents large pieces of material within the emulsion barrel 51 from plugging the system. The hose 153 connects the barrel of emulsion 51 with a fluid filter 52 having a drain 53. A fluid filter is generally known to be useful for minimizing or eliminating contaminants that may clog or contaminate a pump. In the preferred embodiment the fluid filter 52 is a model number 4-13-3/4 P-2-200 which is manufactured by Rose Dale Products, Inc. of Ann Arbor, Mich..

The pressure of the hydraulic fluid from hydraulic pump 26 is further controlled by the use of diverter valve 36. The diverter valve 36 is connected through a pipe 54 to the high pressure hose 31. The operator can move lever 36*a* of the diverter valve 36 to adjust the hydraulic fluids outlet pressure. A gauge 55 connected to diverter valve 36 indicates the pressure of the hydraulic fluid exiting the diverter valve 36. Connected to the diverter valve 36 is a second solenoid valve 56 that controls the flow of fluid to the hydraulic motor 57. The output shaft 58 of hydraulic motor 57 being connected to the hydraulic pump 33 by a flexible drive coupling 59. In the preferred embodiment fluid pressurizing pump 33 is a model 1AMO3 manufactured by Roper Pump Company, Commerce, Ga..

In the preferred embodiment the asphalt emulsion is drawn through a hose 60 from the fluid filter 52 to the fluid pressurizing pump 33. In the preferred embodiment a ball type control valve 61 is utilized to control the fluid flow from fluid filter 52. A second ball type control valve 62 which is identical to the first ball type control valve 61, controls the fluid flow to a back flushing exit conduit 63. In normal operation the control valve 61 is open and control valve 62 is closed which allows the asphalt emulsion to be drawn into the fluid pressurizing pump 33. The asphalt emulsion exits fluid pressurizing pump 33 in a pressurized state and is carried through hose 12 to the spray gun 13.

A gauge 65 is located at the output 160 of pump 33 to indicate the output pressure of the asphalt emulsion fluid. The gauge 65 is disposed between control valves 66 and 67. The control valves 66 and 67 are ball type control valves substantially identical to control valves 61 and 62. In normal operating conditions the ball type control valve 66 remains open and ball type control valve 67 remains closed to allow the flow of asphalt emulsion to hose 12. The four control valves 61, 62, 66 and 67 are arranged such that by closing valves 66 and 61 and opening valves 67 and 62 the fluid pressurizing pump 33 can be backflushed with a solvent, such as kerosene. To facilitate backflushing fluid pressurizing pump 33 an external fluid source (not illustrated) is connected to backflush entry conduit 68 and a solvent is run through the fluid pressurizing pump 33. The solvent exits the fluid pressurizing pump 33 and drains from the system through backflushing exit conduit 63.

A plurality of hydraulic fluid drain lines 69, 70 and 71 are connected to the respective hydraulic motors 40 and 57, diverter valves 35 and 36, and pressure regulator 37 to allow the bypassing hydraulic fluid to be returned to the fluid reservoir 28. An auxiliary fluid filter 73 is connected in series with drain line 72 to remove contaminants from the fluid.

Figure 4:
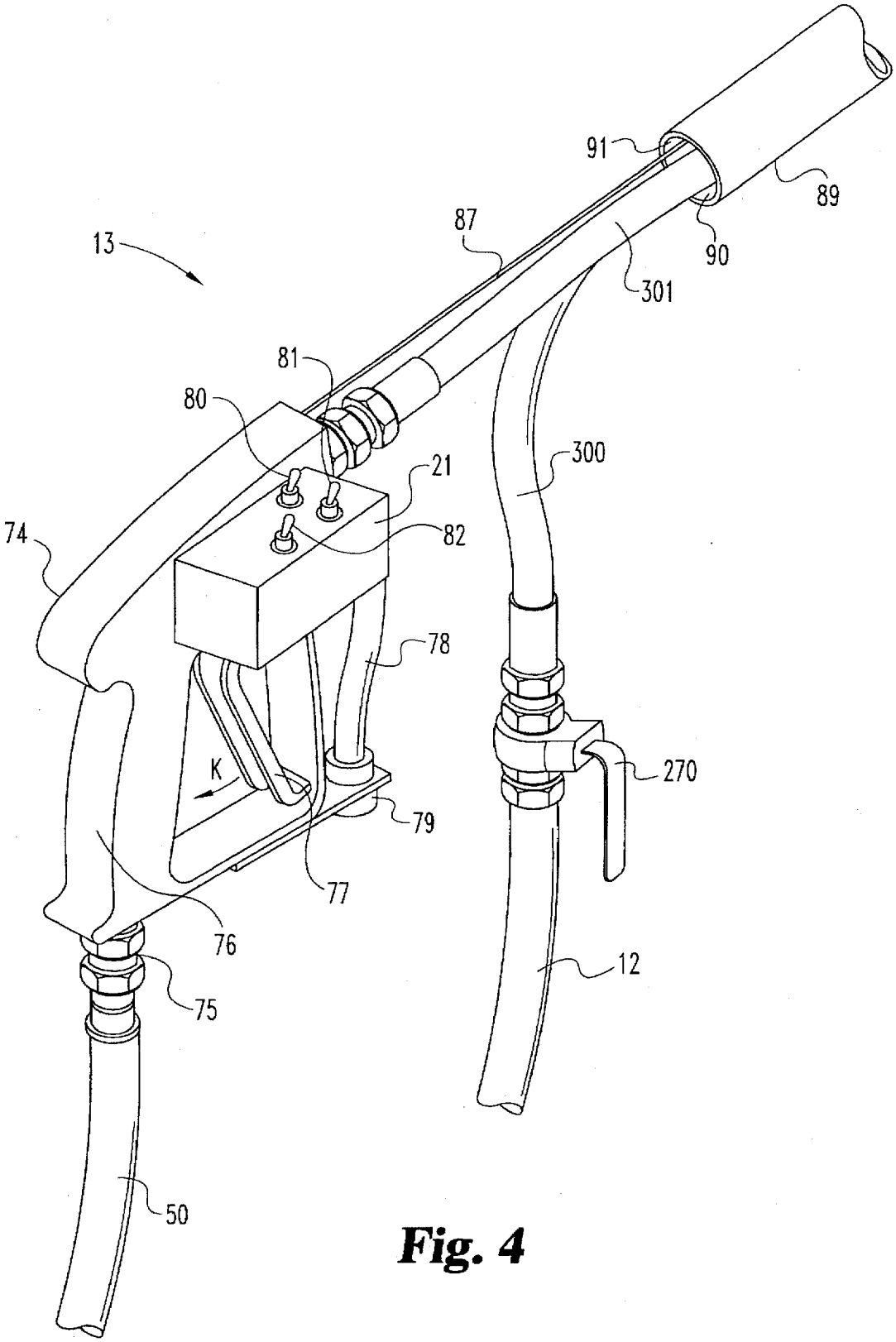
FIG. 4 is a partial perspective view of the spray gun comprising a portion of the waterproofing spray apparatus of FIG. 1.

Referring to FIG. 4, there is illustrated a perspective view of the spray gun 13. In the preferred embodiment the body of the spray gun 13 includes a handle portion 74. The handle portion 74 has an inlet fitting 75 that allows the connection of hose 50 which forms the pathway for the aqueous solution of calcium chloride. The handle portion 74 is ergonomically designed to minimize hand fatigue and to allow the operator 18 maximum control over the spray gun 13. The operator grasps the handle portion 74 such that his fingers are contactable with an actuator 77. In the preferred embodiment the actuator 77 is a trigger that moves from a normally off position to a second position which allows the flow of fluid through the spray gun 13.

The remote control 21 is connected to the handle portion 74 of spray gun 13. In the preferred embodiment the remote control 21 utilizes a hardwired connection to interface with the solenoid valves 39 and 56 and to remotely start the internal combustion engine 25. A wiring harness 78 is wired to the remote control 21 and terminates in a plug 79. A second wiring harness (not illustrated) extends from plug 79 to the appropriate components on the fluid pressurizing apparatus 11. It is understood that the wiring harness that extends from plug 79 back to the fluid pressurizing apparatus is dressed and protected to prevent any abrasion and damage thereto at the job site. In one form of the present invention a single wiring harness extends from the remote control 21 to the spraying apparatus 11.

In the preferred embodiment remote control 21 includes individual switches for controlling components on the fluid pressurization apparatus 11. Switch 80 is connected through the wiring harness to the first solenoid valve 39. Movement of switch 80 from an off position to an on position sends a control signal to the solenoid 85 which will allow the solenoid valve 39 to open when actuator 77 is moved to an on position. A substantially identical switch 81 is utilized to control solenoid 86 which will allow the solenoid valve 56 to open when the actuator 77 is moved to an on position. In the preferred embodiment the switches 80 and 81 are operable independent of each other. In certain situations it is desirable to move one of the switches 80 or 81 to an on position, thereby allowing fluid to flow only through one of the solenoid valves 59 or 39 when the actuator is moved to an on position. Further, in other situations it is desirable to move both of the switches 80 and 81 to an on position, which will allow fluid flow through both solenoid valves 39 and 56 when the actuator 77 is moved to an on position.

A ball type control valve 270 is positioned along hose 12 and provides a mechanical means to start and stop the flow of asphalt emulsion from the fluid pressurizing unit 11 to the spray gun 13. The ball type control valve 270 is connected between hose 12 and hose 300. Internal to the handle portion 74 of the spray gun 13 is a fluid flow valve which controls the flow of calcium chloride solution through the gun. A mechanical link within the handle portion 74 is controlled by the movement of actuator 77. When actuator 77 is moved in the direction of arrow K, the mechanical link opens the fluid flow valve to allow the flow of fluid therethrough.

A lightweight high strength member 87 forms a portion of the body of spray gun 13 and extends from the handle portion 74 to the moveable arm 14. A substantially cylindrical shroud 89 is positioned around member 87 and forms a pair of channels 90 and 91 that hose 300 and 301 pass through. Hose 301 being connected to the handle portion 74 of spray gun 13 and being in fluid communication with hose 50. The shroud 89 provides added structural support for the spray gun 13 and functions to protect the hoses 300 and 301.

Figure 5:
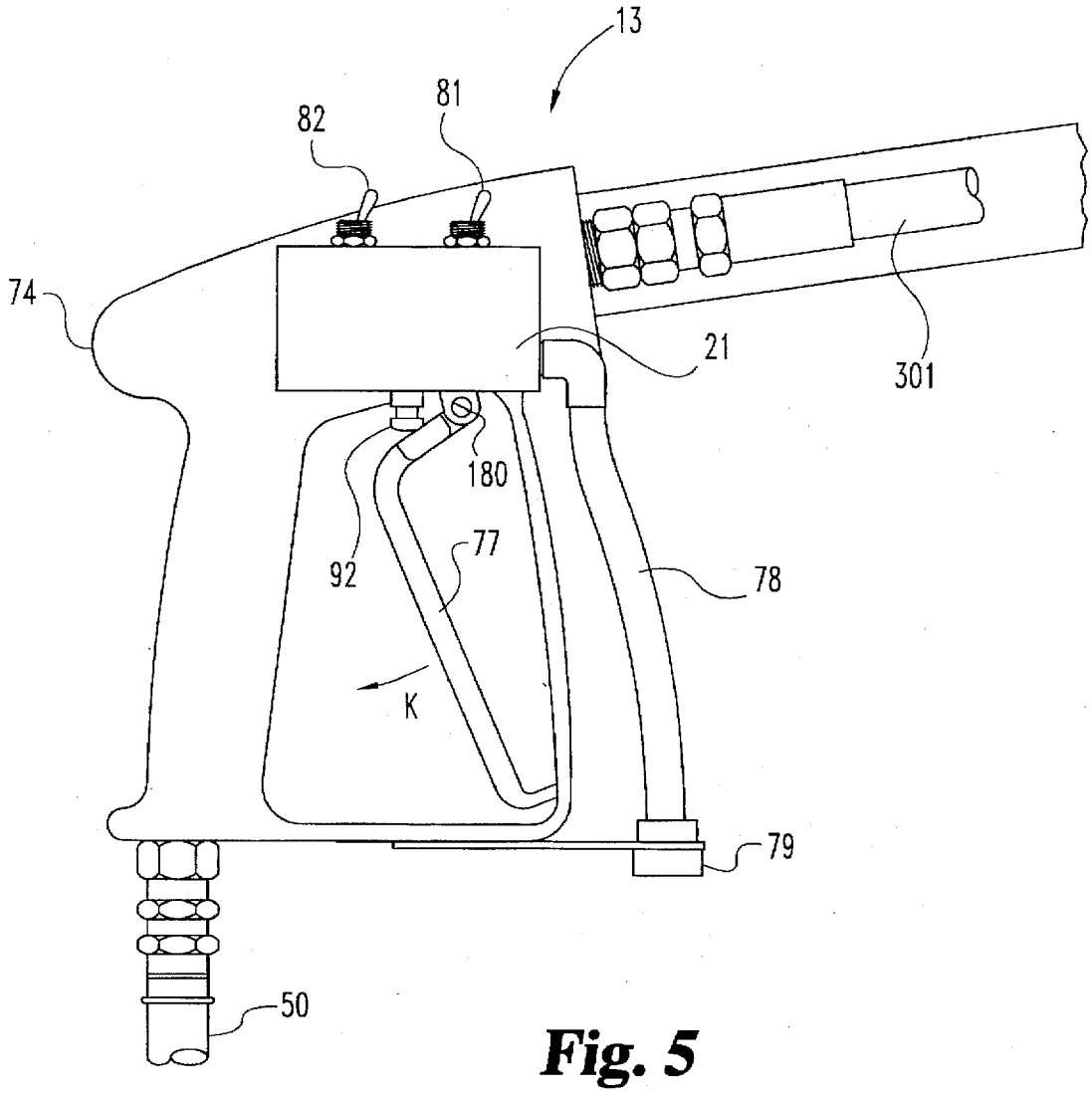
FIG. 5 is a side elevational view of the FIG. 3 waterproofing spray gun.

With reference to FIG. 5, there is illustrated a side elevational view of the handle portion 74 of spray gun 13. The actuator 77 being pivotally connected about a pivot point 180 to the spray gun 13. A switch 92 is positioned on the handle portion 74 to be actuated by the movement of actuator 77. When actuator 77 is moved in the direction of arrow k the switch 92 moves from a normally off position to an on position. When the switch 92 is moved to the on position the solenoids 85 and 86 that have received the appropriate control signal from switches 80 and 81 are now energized, and will allow the flow of fluid to the spray gun 13.

Figure 6:
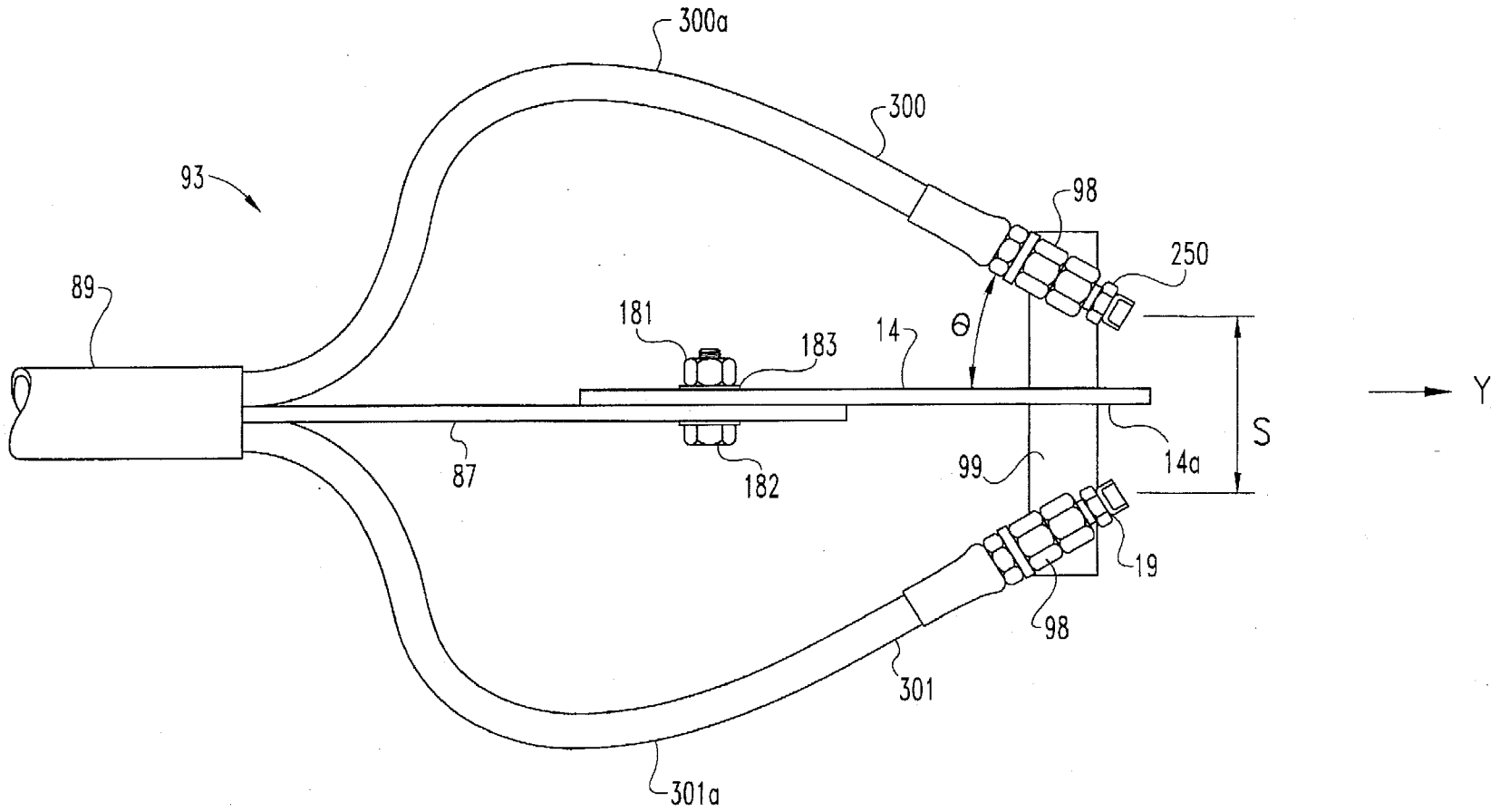
FIG. 6 is a top plan view of the nozzle end of the FIG. 3 spray gun.

With reference to FIG. 6, there is illustrated the distal end 93 of the spray gun 13. The member 87 has the moveable arm 14 connected thereto by an interengaging nut 181 and bolt 182 combination. A fiber washer 183 provides the necessary resistance to the random movement of moveable arm 14. The moveable arm 14 extending beyond the end of nozzles 19 and 250. The distal end **14*a* of the moveable arm 14 extends beyond the nozzles to prevent their engagement with the wall 16, and functions as a buffer or bumper. In the preferred embodiment the spray gun 13 includes partial coils 300*a* and 301*a* of hoses 300 and 301 to accommodate the movement of moveable arm 14. Each of the hoses 300 and 301 are connected to a fitting 98 which is attached to a cross member 99. The cross member 99 is connected to the moveable arm 14 and allows for holding the nozzles 19 and 250 in a spaced apart relationship. In the preferred embodiment the nozzles 19 and 250 are positioned at an angle θ to the central axis y. In one form of the invention the nozzles are spaced apart a distance s. In the preferred embodiment the distance s is 2¾" inches from the respective center of each nozzle 19 and 250**.

The nozzle 19 for spraying the aqueous solution of calcium chloride nozzle 19 is a stainless steel model #4002 or 4001 nozzle manufactured by Spraying Systems Co. of Wheaton, Ill. and the nozzle 250 for spraying the asphalt emulsion fluid is a model #4010 manufactured by Spraying Systems Co. of Wheaton, Ill.. In the preferred embodiment the nozzles produce a fan of 40°, and the outlet aperture in the emulsion nozzle 250 is larger than the outlet aperture in the nozzle 19. The nozzle 19 for spraying the aqueous solution of calcium chloride provides finer fluid droplets. Other nozzles are contemplated provided that they provide the desired delivery characteristics.

Figure 7:
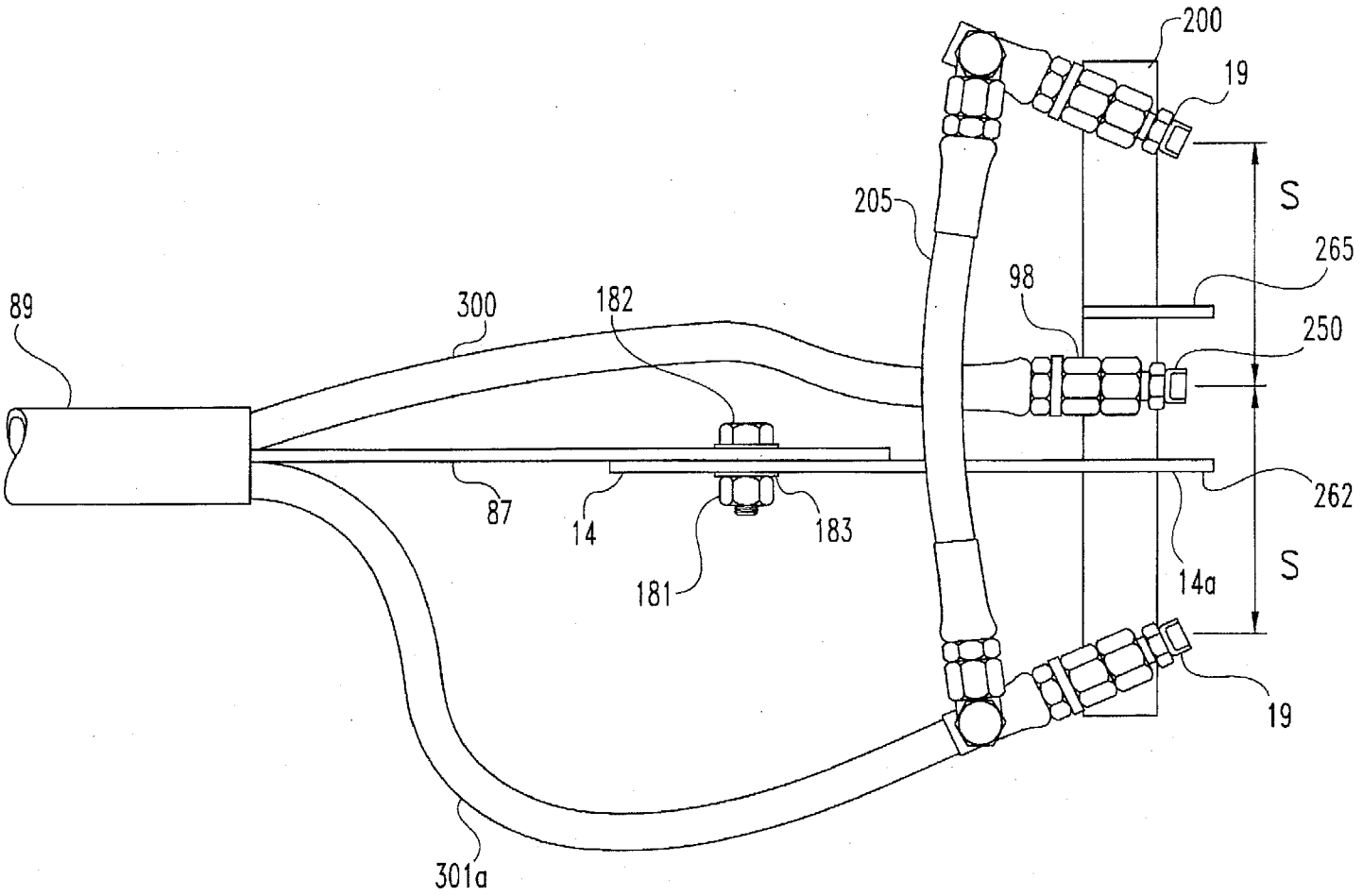
FIG. 7 is a top plan view of the nozzle end of another form of the FIG. 1 spray gun.

With reference to FIG. 7, there is illustrated an alternate form of the present invention. Positioned on the distal end **14*a* of moveable bar 14 is cross member 200. Cross member 200 serves the same function as cross member 99, however, in this form of the invention it holds three nozzles thereon. The asphalt emulsion hose 300 is positioned centrally along the member 87. A fitting 98 is mounted substantially central on the cross member 200 to hold the hose 300 in place, and the emulsion nozzle 250 is than received into the fitting 98. The calcium chloride hose 301 is positioned substantially the same as in the embodiment of FIG. 5, however a cross connect hose 205 links the calcium chloride hose 301 to a second nozzle 19 for spraying the aqueous calcium chloride solution. In the alternate form of the present invention the aqueous solution of calcium chloride is sprayed from the two spaced apart nozzles 19 and, the asphalt emulsion is sprayed through the central emulsion nozzle 250. The calcium chloride nozzles 19 being spaced outwardly a distance 's' form the center of the emulsion nozzle 250**, with the distance 's' being 2¾ inches.

The distal end **14*a* of moveable arm 14 and a member 265 extend beyond the end of the nozzles 250 and 19. A portion 262 of the moveable bar 14 and the member 265 provide shielding for the nozzle 250 to reduce or eliminate the dropping of calcium chloride solution from nozzles 19 onto nozzle 250. This feature prevents or minimizes the hardening of the asphalt emulsion on the surface of the nozzle 250**.

With reference to FIGS. 1–7 an example will now be set forth illustrating how the waterproofing spray apparatus 10 may be utilized. The waterproofing spray apparatus 10 is readily transportable and will be delivered to the job site by a truck, and at the job site can be readily moved around by a fork lift, or other suitable means. At the work site the operator will select a portion of the basement wall 16 that he wishes to align the nozzles 19 and 250 of the spray gun 13 therewith. The selection of the portion of the surface to be sprayed is necessary to determine what angle of deflection is most desirable to have the moveable arm 14 oriented thereto. After selecting the portion of surface that he wishes to align the nozzles 19 and 250 of the spray gun 13 therewith, he will position the distal end **14*a* of moveable arm 14 adjacent the basement wall 16. The operator now pushes or taps the moveable arm 14 against the basement wall 16 with sufficient force to cause the moveable arm 14 to pivot about point 101. When the moveable arm 14 has been rotated to the desired position the operator will stop applying the external force and the combination of the fiber washers 183 and nut and bolt combination will hold the moveable arm in its deflected position relative to the member 87. Orienting the moveable arm 87 with nozzles 19 and 250 relative to the outer surface of basement wall 16 will facilitate the spraying of waterproofing coating thereon. It is important to note that is desirable to have the nozzles spaced a distance 't' from the outer surface of wall 16**. In the preferred embodiment the spacing is in the range of about 8–10 inches.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A spraying apparatus for delivering a fluid coating composition onto a surface to form a waterproofing coating, comprising:

a first pressurizing pump for pressurizing a first component of the coating composition for delivery to the surface;

a second pressurizing pump for pressurizing a second component of the coating composition for delivery to the surface;

a hand held spray gun in fluid communication with said first and second pumps for spraying at least one component of the coating composition;

a first liquid passageway coupled to said spray gun for the passage of said first component from said first pump to said spray gun;

a second liquid passageway coupled to said spray gun for the passage of said second component from said second pump to said spray gun, said first and second liquid passageways not in fluid communication; and an actuator located on said spray gun and moveable to a first state and a second state, said first state for allowing the passage of fluid through only one of said passageways, and said second state for allowing the passage of fluid through both of said passageways.

2. The spraying apparatus of claim 1, which further includes:

first control means proximate said first pump for controlling the operation of said first pump;

second control means proximate said second pump for controlling the operation of said second pump; and a switch located on said spray gun for controlling at least one of said control means.

3. The spraying apparatus of claim 2, wherein said first and second liquid passageways are defined within moveable hoses.

4. The spraying apparatus of claim 3, wherein said pumps are driven by high pressure hydraulic fluid, and said spray gun having an elongated arm extending therefrom, said arm having a nozzle attachment end.

5. The spraying apparatus of claim 4, which further includes a pair of nozzles spaced apart on said nozzle attachment end, one of said pair of nozzles being in fluid communication with said first pump and the other of said pair of nozzles being in fluid communication with said second pump.

6. The spraying apparatus of claim 5, which further includes:

a base unit sized to fit within a truck;

an internal combustion engine coupled to said base unit;

a hydraulic pump driven by said internal combustion engine for providing pressurized fluid to said engine;

said nozzles being oriented at an angle to the surface being sprayed; and said first component being a coagulant and said second component being an emulsion.

7. The spraying apparatus of claim 1, wherein said spray gun includes a pivotable arm, and said spray gun includes a pair of nozzles in fluid communication with one of said pumps, and a single nozzle in fluid communication with the other of said pumps.

8. A method for aligning the nozzles of a waterproofing spraying apparatus with portions of a surface to be covered with a waterproofing coating, comprising:

providing a handheld spraying apparatus with a pivotable arm, the pivotable arm having the nozzles coupled thereto;

positioning the pivotable arm proximate the surface to be covered with the waterproofing coating; and contacting the surface with the pivotable arm so as to move the arm from an extended position to a deflected position.

9. A spray apparatus for delivering components of a waterproofing coating including a coagulant and an emulsion to a surface, comprising:

a handheld body for grasping and manipulation by a human;

a mechanical arm coupled to said body, said arm having a fixed portion and a pivotable portion coupled thereto, said pivotable portion pivotable with respect to said fixed portion between an extended position and a deflected position;

a pair of coagulant discharge nozzles coupled to said pivotable arm for the discharge of coagulant from the spray apparatus;

an emulsion discharge nozzle coupled to said pivotable arm for the discharge of emulsion therefrom, said emulsion discharge nozzle located centrally between said pair of coagulant discharge nozzles; and a pair of conduits extending along at least a portion of said arm, said pair of conduits preventing the mixing of the components within the spray apparatus prior to discharge from said nozzles.

10. The apparatus of claim 19, wherein said pivotable portion being normally resisted from pivoting by friction forces, and wherein said fixed portion being longer than said pivotable portion.

11. The apparatus of claim 10, which further includes a pressurizing means for pressurizing at least one of the components for delivery from the spray apparatus.

12. The apparatus of claim 10, which further includes a pair of pumps, one of said pair of pumps for pressurizing the coagulant and the other of said pair of pumps for pressurizing the emulsion.

13. The apparatus of claim 12, wherein said pair of coagulant discharge nozzles are inclined relative to the surface being sprayed.

14. A spray apparatus for delivering components of a waterproofing coating including a coagulant and an emulsion to a surface, comprising:

a handheld body for grasping and manipulation by a human, said body having a trigger coupled thereto for allowing the release of components from the spray apparatus;

a mechanical arm coupled to said body, said arm having a fixed portion and a pivotable portion coupled thereto, said pivotable portion pivotable with respect to said fixed portion between an extended position and a deflected position;

a pair of nozzles coupled to said pivotable arm for the discharge of components from the spray apparatus, one of said pair of nozzles is for the delivery of coagulant and the other of said pair of nozzles is for the delivery of emulsion;

actuation means for independently controlling the release of each of the components when said trigger is activated to release fluid; and a pair of conduits extending along at least a portion of said body and said arm, said pair of conduits preventing the mixing of the components within the spray apparatus prior to discharge from said nozzles.

* * * * *

UNITED STATES PATENT AND TRADEMARK OFFICE

CERTIFICATE OF CORRECTION

PATENT NO. : 5,671,889

DATED : September 30, 1997

INVENTOR(S) : Ralph S. Petty

It is certified that error appears in the above-identified patent and that said Letters Patent is hereby corrected as shown below:

In col. 10, line 47, please change "19" to --9--.

Signed and Sealed this

Twenty-third Day of December, 1997

Bruce Lehman

*Attest:*

BRUCE LEHMAN

*Attesting Officer*

*Commissioner of Patents and Trademarks*